United States Patent [19]

Ackeret

[11] Patent Number: 5,007,537

[45] Date of Patent: Apr. 16, 1991

[54] SLEEVE FOR A PHOTOPRINT CASSETTE

[75] Inventor: Peter Ackeret, Kusnacht, Switzerland

[73] Assignee: Licinvest AG, Chur, Switzerland

[21] Appl. No.: 196,215

[22] PCT Filed: Jul. 11, 1987

[86] PCT No.: PCT/EP87/00374

§ 371 Date: Jun. 7, 1988

§ 102(e) Date: Jun. 7, 1988

[87] PCT Pub. No.: WO88/00721

PCT Pub. Date: Jan. 28, 1988

[30] Foreign Application Priority Data

Jul. 18, 1986 [DE] Fed. Rep. of Germany ..... 3624263
Sep. 13, 1986 [DE] Fed. Rep. of Germany ..... 3631212

[51] Int. Cl.[5] ..... B65D 85/48

[52] U.S. Cl. ..... 206/455; 40/156; 229/9; 229/19; 229/162; 206/232

[58] Field of Search ..... 206/449, 450, 453–456, 206/444, 387, 232, 424; 229/9, 19, 162, DIG. 5, 68 R, 71, 72; 40/152, 156

[56] References Cited

U.S. PATENT DOCUMENTS

| | | | |
|---|---|---|---|
| 1,822,576 | 9/1931 | Greve | 229/9 |
| 2,327,713 | 8/1943 | Hunter | 206/455 |
| 2,681,175 | 6/1954 | David | 229/71 |
| 3,710,977 | 1/1973 | Van den Enden et al. | 206/455 X |
| 3,835,988 | 9/1974 | Buttery | 224/162 X |
| 4,443,959 | 4/1984 | Ackeret | 40/152 |
| 4,552,268 | 11/1985 | Lee | 206/455 |
| 4,640,413 | 2/1987 | Kaplan et al. | 206/232 |
| 4,653,639 | 3/1987 | Traynor | 206/444 |
| 4,674,632 | 6/1987 | Friedman | 206/232 |
| 4,703,854 | 11/1987 | Cline | 229/DIG. 5 |
| 4,828,105 | 5/1989 | Silengo et al. | 206/232 |

FOREIGN PATENT DOCUMENTS

| | | | |
|---|---|---|---|
| 904804 | 7/1972 | Canada | 206/387 |
| 2605440 | 8/1977 | Fed. Rep. of Germany | 206/455 |
| 3151649 | 3/1983 | Fed. Rep. of Germany . | |
| 3200306 | 7/1983 | Fed. Rep. of Germany . | |
| 8603021 | 5/1986 | PCT Int'l Appl. . | |

*Primary Examiner*—Bryon P. Gehman
*Attorney, Agent, or Firm*—Jeffrey H. Ingerman

[57] ABSTRACT

A sleeve for a photoprint cassette having a feature for holding a paper bag which accommodates strips of photographic neggatives. The sleeve, combined with the photoprint cassette and the paper bag, forms a module of a photo archive.

62 Claims, 7 Drawing Sheets

SLEEVE FOR A PHOTOPRINT CASSETTE

The present invention relates to the field of photography, and in particular to the field of storing and display of photographic prints.

Some photofinishing laboratories or photograph printers deliver prints ("positives") drawn from a customer's film after development thereof in cassettes, hereinunder referred to as photoprint cassettes. Such cassettes are designed to accommodate all prints taken from a standard size roll of film, e.g. forty prints. Some types of photoprint cassettes are suited also to serve as a frame to display one of the prints housed therein, and for this purpose, a transparent window is provided in one of two substantially parallel side walls. An example of such a cassette is disclosed in PCT INTERNATIONAL PUBLICATION number WO 86/03021.

Such photoprint cassettes may be used instead of albums for storing the prints, and for this purpose, such cassettes may be stacked. However, it is not really convenient to remove a particular cassette from such a stack. It would be more convenient to arrange the cassettes in the manner in which books ordinarily are stored on a shelf or the like, i.e. with one the narrow walls supported. A row on a shelf formed by a plurality of cassettes, however, would be unstable, with the risk of damage, and particularly with the risk that the transparent windows of the cassettes might become scratched.

Photograph printers, of course, deliver to their customers not only the prints but also the developed film ("negatives"), and usually this is done in a paper bag. The customer has the additional problem of storing his negatives such that he may conveniently locate a particular frame of which he wants to get additional prints. An approach to solve this problem in connection with photoprint cassettes is disclosed in U.S. Pat. No. 4,443,959: A photo archive comprises a number of print cassettes stacked to form a pile, and a lowermost cassette in the pile is designed to accommodate negative strips instead of prints.

The present invention addresses the problems mentioned above in another manner. Each cassette is provided with a sleeve which is of substantially cuboid shape so that the sleeve may stand on a shelf independent of lateral support, and in addition, each sleeve is provided with means to hold a paper bag, i.e. the bag in which the negative strip had been delivered. In this manner, the user has immediate access to negatives belonging to the prints in the respective cassette, and a plurality of such modules—each comprising a sleeve, a cassette and a negative paper bag—make up a perfectly organized archive.

It is to be noted that the sleeve may carry a label on which the user may indicate the contents of the respective cassette so that the latter remains clean and feasible as an attractive frame hung on a wall or disposed on a table.

Embodiments of the invention are illustrated in the attached drawings and will be explained in detail hereunder.

Figure 1:
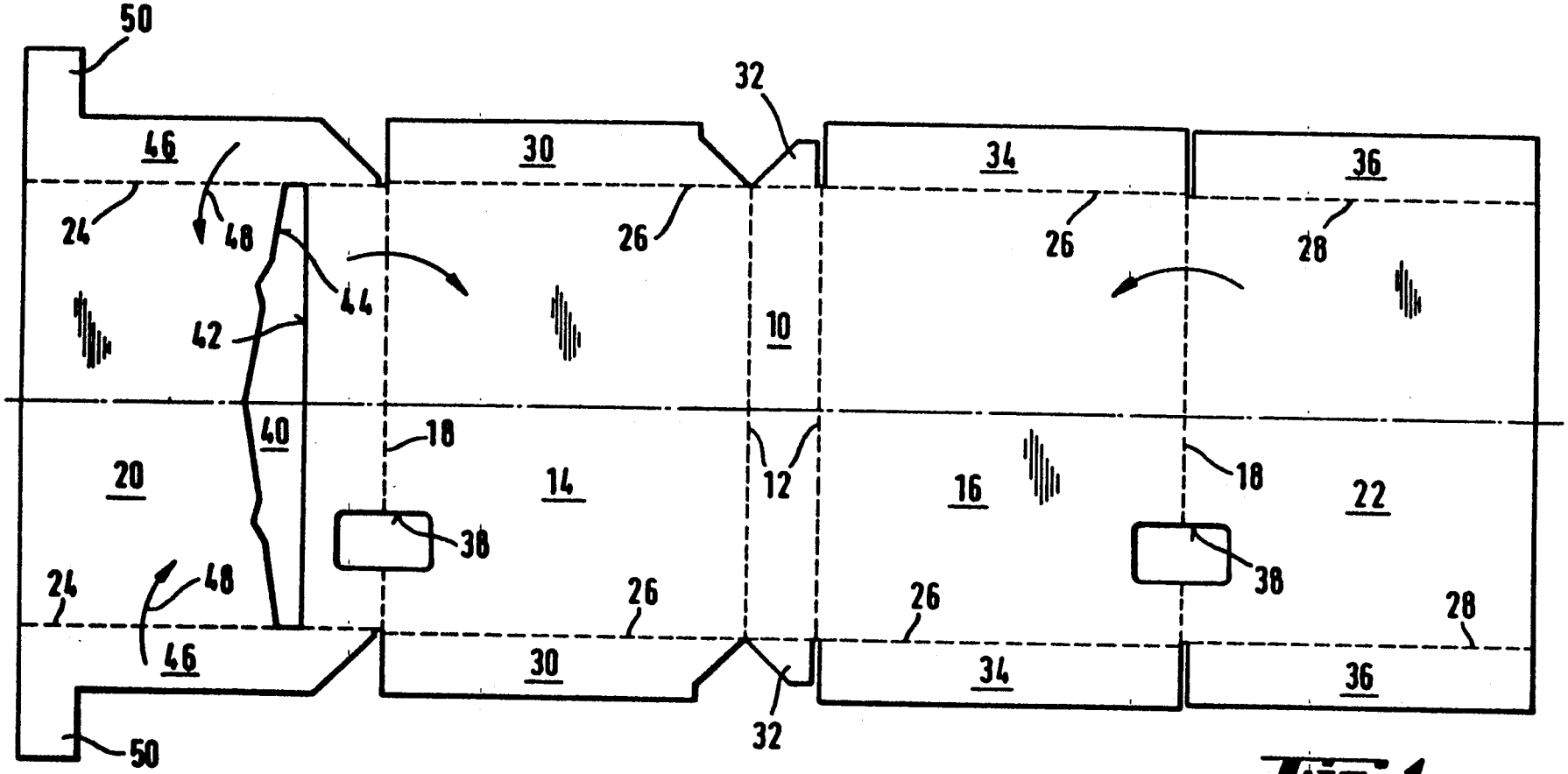
Figure 2:
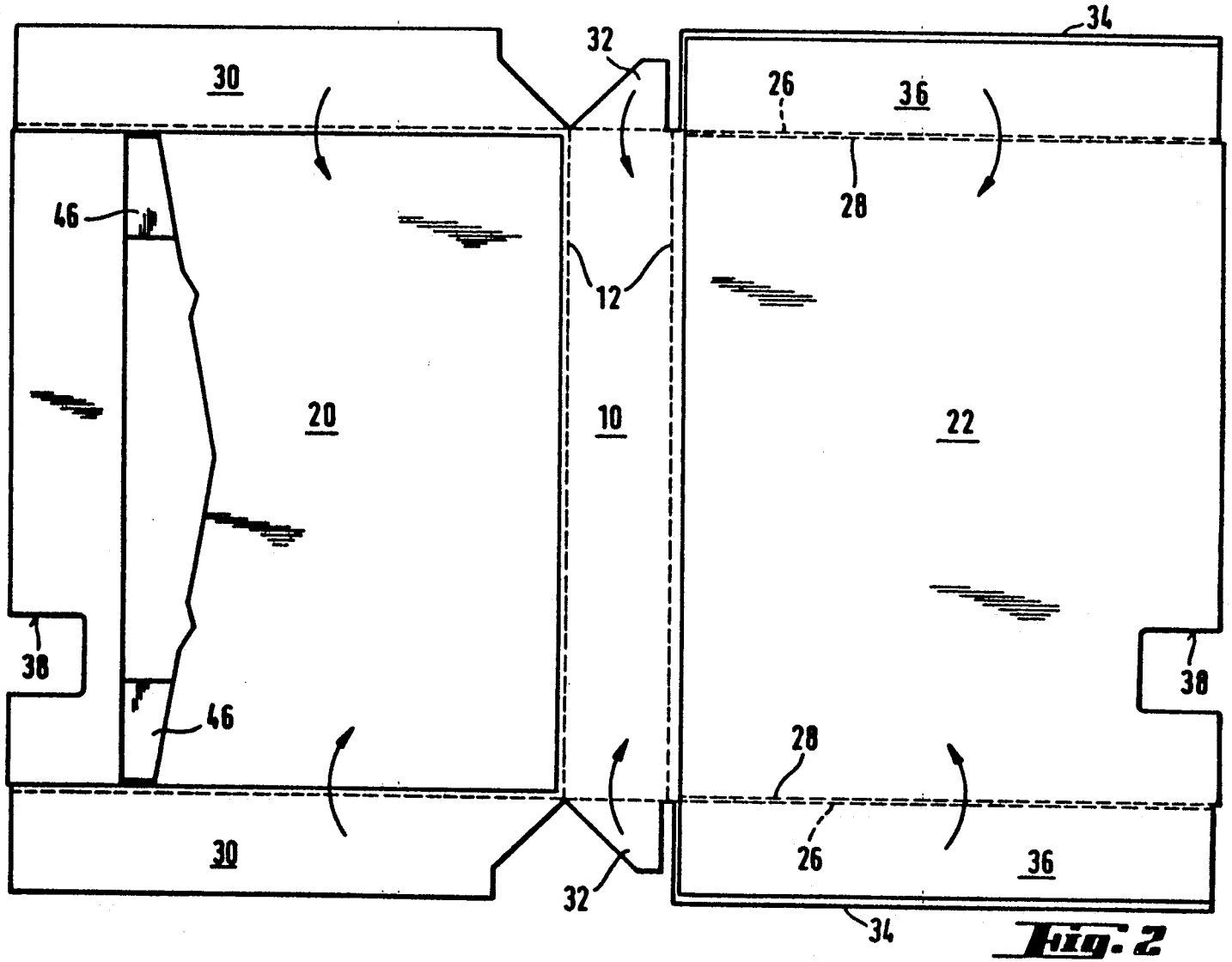
Figure 3:
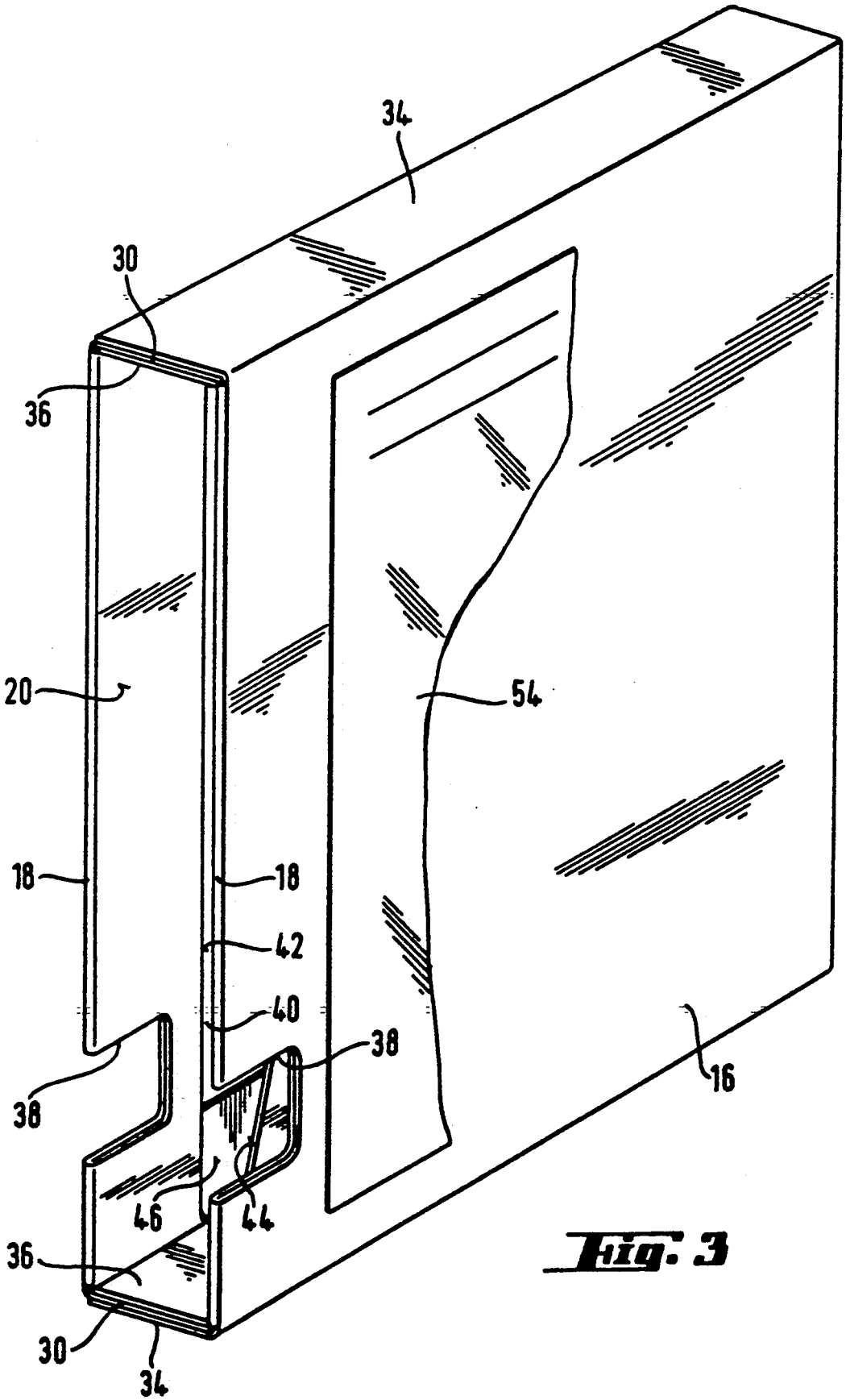
Figure 4:
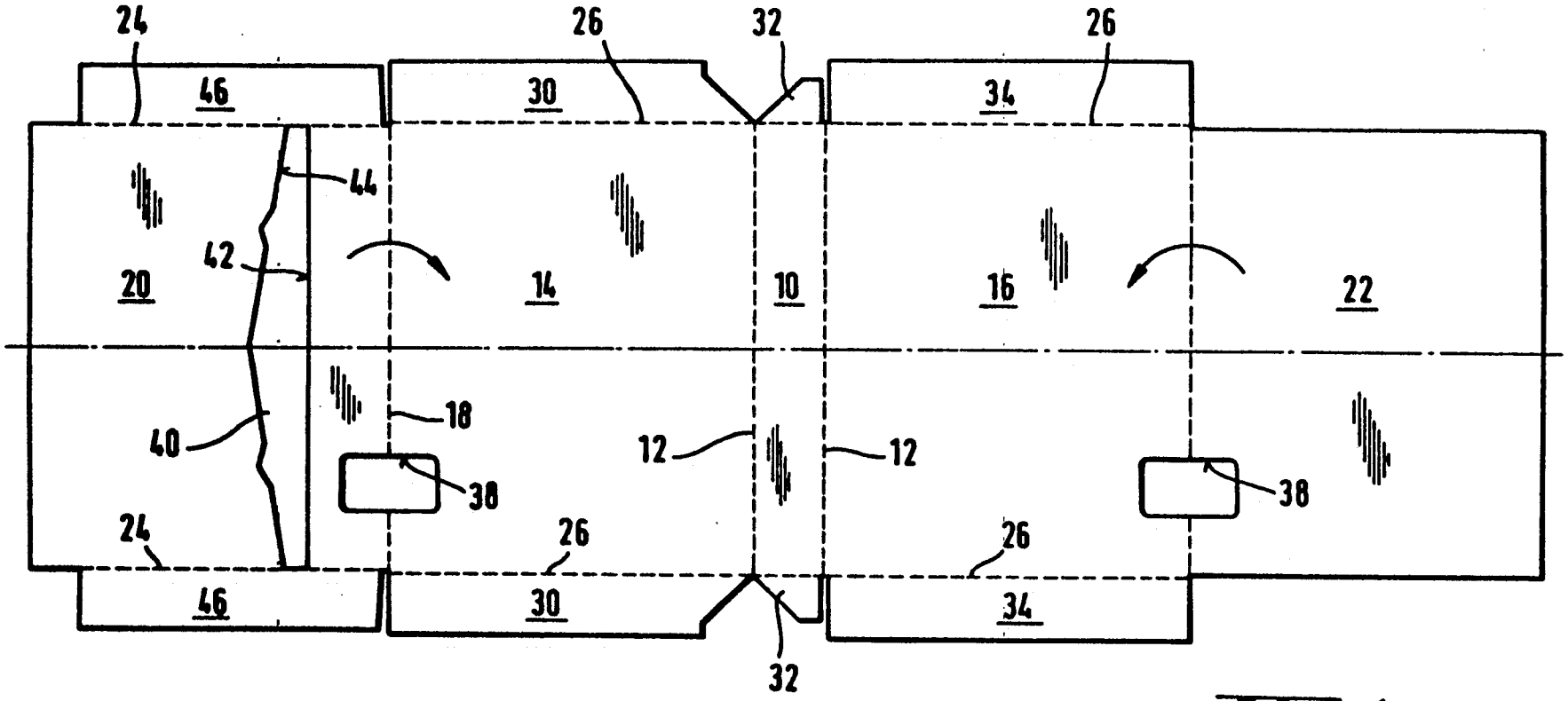
Figure 5:
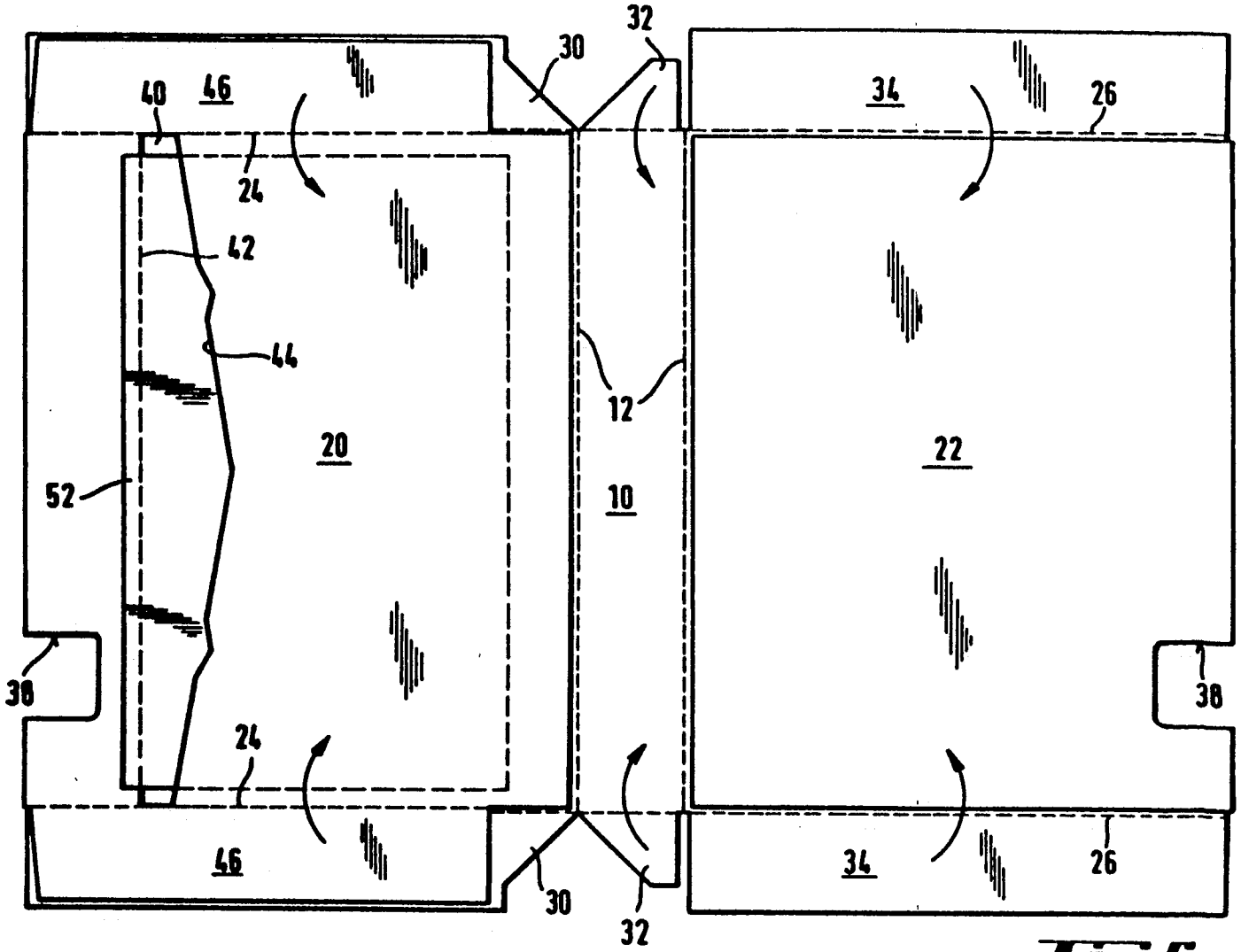
Figure 6:
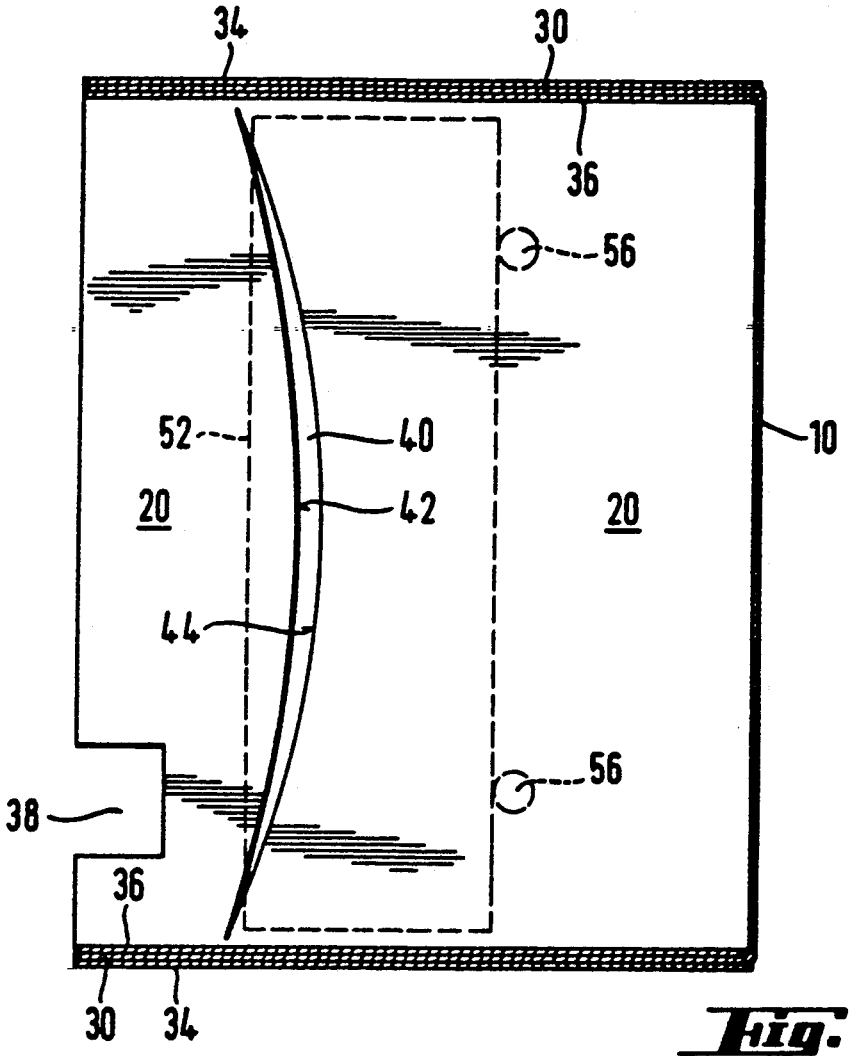
Figure 7:
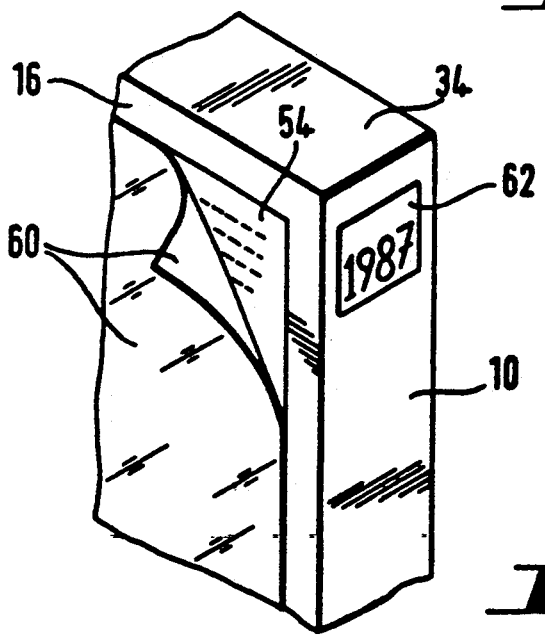
Figure 8:
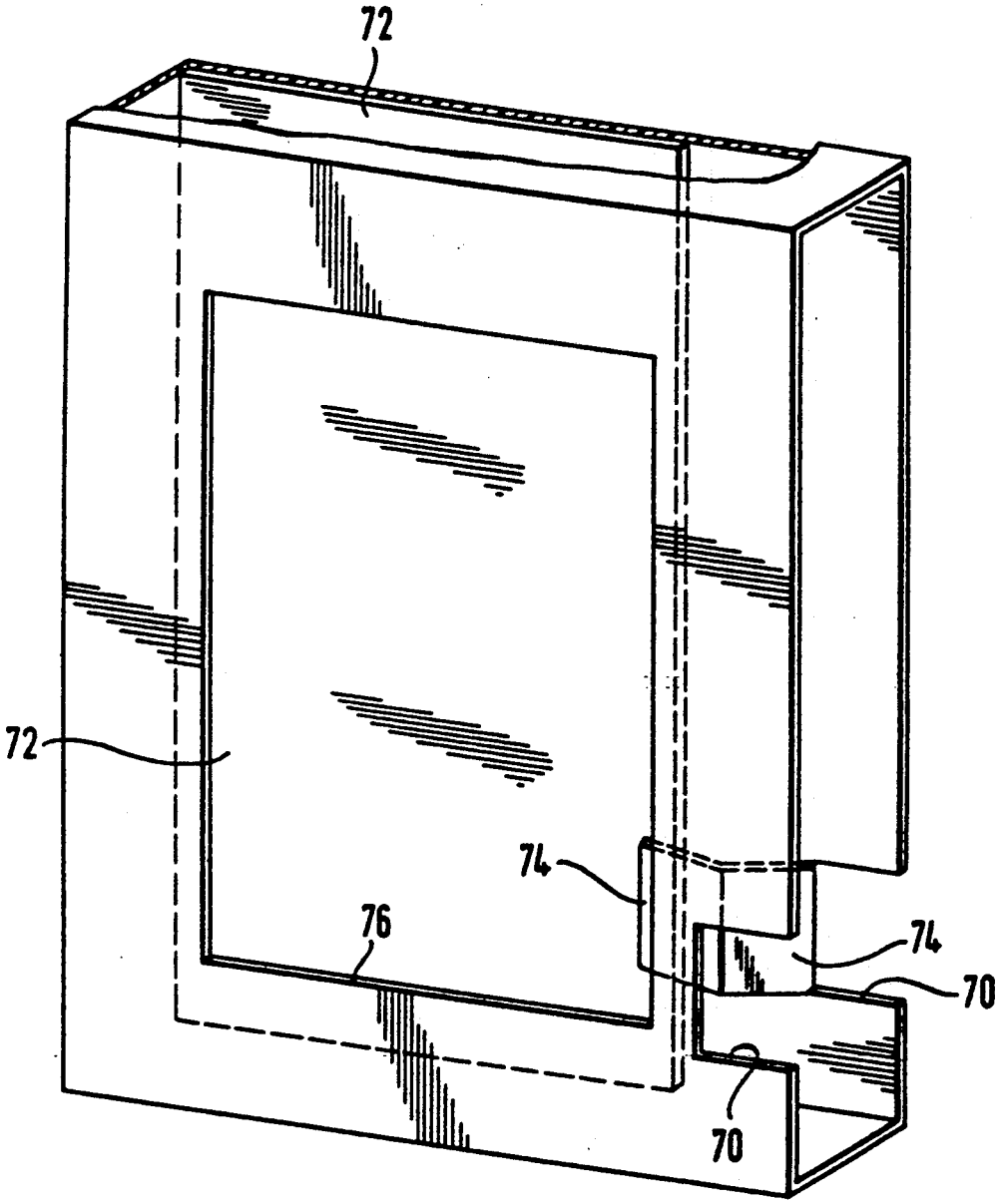

FIG. 1 is a plan view of a box-board blank from which a sleeve according to the invention is folded, FIG. 2 illustrates a semi-finished sleeve produced from the blank shown in FIG. 1, FIG. 3 is an isometric view of the sleeve when ready, FIG. 4 is a plan view of a box-board blank for a sleeve of modified design, FIG. 5 illustrates the semi-finished status of the modified sleeve, FIG. 6 is a longitudinal section of a third embodiment, FIG. 7 is a partial isometric view thereof, and FIG. 8 is an isometric view of a fourth embodiment.

The blank shown in FIG. 1 is made of box-board provided, on one of its faces, with a smooth surface; the board may be coated, laminated or treated otherwise to obtain the desired smoothness. It is, alternatively, also possible to use plastic material, e.g. a film made of polypropylene or polyvinyl chloride. In FIG. 1, the non-treated (rough) face of the material is shown. The cut-out contour is illustrated by solid lines, dashed lines indicate folding lines, and a dash-dotted line is a center line.

The blank comprises a rear wall portion 10 connected, by folding lines 12, to outer side wall portions 14 and 16, respectively. The latter are connected, by folding lines 18, to inner side wall portions 20 and 22, respectively. Folding lines 24, 26, and 28 extend transversely with respect to lines 12 and 18; lines 24 and 26 are positioned somewhat more inwards than line 28. Lines 26 and 28 define flaps 30, 32, 34, and 36 which will form, after folding and glueing, the shorter narrow sides of the sleeve, i.e. top wall and bottom wall of the latter.

The blank has three cutouts: Two small rectangular ones 38 define fingertip cutouts of the sleeve when folded, and a slot-shaped cutout 40 is defined by a first free edge 42 parallel to lines 18 and an angled second free edge 44 and extends over substantially the entire height of the sleeve.

Folding lines 24 separate flaps 46 from inner side wall portion 20, and these flaps are at first folded, as indicated by the arrow, onto the rough face of said portion 20. Lugs 50 of those flaps may be glued onto portion 20. In a following step, inner side wall portions 20 and 22 are folded over the outer side wall portions 14 and 16, respectively, so that the rough sides engage each other, and the facing surfaces are glued together near folding lines 18 and near the free edges of portions 20, 22. In this manner, a thickened portion of the sidewall and a pocket are defined by portions 14 and 20, the pocket being accessible via slot 40 and having a depth limited by the glue adjacent the near folding line 12 or by the edges of lugs 50. FIG. 2 illustrates this condition. It will be noted that the inner side wall portions are slightly shorter than the outer portions so that the sleeve, in spite of the material thickness, may be completed by folding portions 30 through 36 about lines 12 and 26, and fastening by means of glueing. During this step, portion 36 will be in the interior of the sleeve because its inner surface is smooth. FIG. 3 illustrates the completed sleeve and in particular the access slot 40 permitting insertion of a paper bag which contains negative strips.

FIGS. 4 and 5 illustrate a second embodiment similar to the first one, and like reference numerals are used to identify equivalent parts. Only the differences of the second embodiment are explained hereunder:

Portions 36 and lugs 50 have been omitted. The assembly of the sleeve according to FIG. 4 is started by inwardly folding the inner side wall portions 20 and 22, respectively, onto the outer ones 14 and 16, respectively, and said portions are glued together as heretofor described, i.e. so to form a pocket accessible via slot 40. The depth of the pocket is dimensioned such that a paper bag of standard size for negative strips just protrudes beyond the slot when the bag 52 abuts within the pocket at the glue seam between portions 14 and 20. The completion of the sleeve will then continue as described above with respect to FIGS. 1 through 3.

It will be observed that, although the first embodiment is somewhat more complicated to manufacture, has the advantage over the second embodiment that, because of the folding of flaps 46 onto portion 20, a certain tension is effective upon the edges defining the slot 40 so that the latter has less tendency to spread apart.

This effect may be further enhanced by cutting the box-board such that its fibrous texture extends in direction substantially parallel to the slot 40.

In FIG. 3, outer side wall portion 16 is provided with a label showing an index or the like. This position is preferred to minimize the risk of damage for negatives potentially housed in the pocket.

The width of the sleeve between its side walls is dimensioned such that the print cassette plus a paper bag holding a maximum number of negative strips may be accommodated. The height of the sleeve between top and bottom wall is such that the cassette snugly fits therebetween and the side walls are stretched to remain substantially plane even if a rather thick paper bag is in the pocket.

FIGS. 6 and 7 illustrate a third, modified embodiment. The side wall shown in FIG. 6 is double-walled, and its inner portion 20 presents a slot, defined by two circular arcs of different radii so that the slot has a crescent contour. The slot permits insertion of a negative strip filled paper bag to be inserted into the cavity until the bag, indicated in dashed lines, abuts stops 56 formed preferably by glue connecting inner and outer portions of the side wall in question.

FIG. 7 illustrates an index field or label field on one of the large side walls, preferably on the side wall 16 opposite wall 20. The label field 54 may be protected by a cover film 60 made of transparent plastic which, prior to its very application, may be used as a carrier for a marker indicating, e.g. a certain annum, to be disposed on a predetermined field 62 on the rear of the sleeve.

FIG. 8 shows a fourth embodiment. The sleeve is made of a thermoplastic material, and polypropylene, polyvinylchloride, polyethylene and others are suited for this purpose. The sleeve may be manufactured by any known process, as injection molding, and exhibits fingertip cutouts 70, as illustrated. A paper bag 72 for photographic negatives is held adjacent the inner face of one of the large side walls by means of a tongue 74 integrally formed therewith. The tongue, preferably, is cut from the side wall and bent inwards where the fingertip cutout is provided. Tongue 74 has a generally L-shaped section, and particularly that of a flat V, so that the cassette, when slipped into the sleeve, does not interfere with the tongue. The entire sleeve may be made of a transparent material or, as shown, of an opaque material provided with a window 76 preferably congruent with a window of a cassette to be accommodated in the sleeve.

The cassette, the sleeve and the paper bag all have dimensions adapted to the goods to be accommodated therein. The cassette, of course, is designed to house photoprints of a predetermined format, and the sleeve is designed to snugly accommodate the cassette and the paper bag for the negative strips. The paper bag, in turn, has a height substantially fitting into the height of the sleeve, and a width such that it fits between the sleeve rear wall and the tongue.

I claim:

1. A sleeve for a picture cassette, including a first large side wall, a second large side wall parallel to said first large side wall, a narrow top wall, a narrow bottom wall parallel to said narrow top wall, and a rear wall, said large side walls being interconnected by said top, bottom, and rear walls, front-defining edges of said large side walls and of said top and bottom walls remote from said rear wall defining an open front, one of said large side walls comprising a pocket for holding a flat object, said pocket including a first inner wall portion separating said pocket from a cassette-receiving space, a free edge of said first inner wall portion defining an access opening for free insertion and removal of said flat object into and from said pocket via said open front, said pocket and said access opening extending substantially over an inner height of said sleeve between said top and bottom walls, said first inner wall portion being connected to a flap along a folding line perpendicular to said rear wall, said flap being folded about said folding line so as to lie parallel to an adjacent one of said top, bottom, and side walls and mounted to keep said first inner wall portion in a position substantially parallel to said one large side wall.

2. The sleeve of claim 1 wherein said free edge of said first inner wall portion is positioned between said open front and said rear wall.

3. The sleeve of claim 2 wherein said free edge is closer to the open front than to the rear wall.

4. The sleeve of claim 1 wherein said free edge extends substantially parallel to that edge of said one large side wall which defines said open front.

5. The sleeve of claim 1 wherein said pocket has at least one stop which limits the insertion depth of said flat object.

6. The sleeve of claim 5 wherein said stop is defined by glueing.

7. The sleeve of claim 5 wherein said stop is defined by said rear wall.

8. The sleeve of claim 5 wherein at least portions of said free edge are spaced from said stop by a distance which is smaller than the insertion depth of said flat object.

9. The sleeve of claim 1 wherein said free edge extends at least in part at an angle with respect to said front-defining edge of said one large side wall.

10. The sleeve of claim 9 wherein said free edge is crescent shaped.

11. The sleeve of claim 1 wherein said first inner wall portion has a second free edge adjacent said rear wall.

12. The sleeve of claim 1 wherein said first inner wall portion has an additional edge coextensive with said rear wall.

13. The sleeve of claim 1 wherein said flap is folded to lie between said first inner wall portion and said one large side wall.

14. The sleeve of claim 1 wherein said flap is folded to lie parallel to said top and bottom walls.

15. The sleeve of claim 13 or 14 wherein said flap is glued to those sleeve parts onto which it is folded.

16. The sleeve of claim 1 wherein said one large side wall is thickened between said free edge and said front-defining edge of said one large side wall.

17. The sleeve of claim 16 wherein said one large side wall is thickened by a blank portion connected to said one large side wall.

18. The sleeve of claim 17 wherein said blank portion is connected to said one large side wall portion by gluing.

19. The sleeve of claim 17 wherein said blank portion and said one large side wall portion form a common blank, said blank portion being folded about said front-defining edge of said one large side wall.

20. The sleeve of claim 19 wherein said first inner wall portion and said blank portion form a common blank and are connected bilaterally with respect to said free edge.

21. The sleeve of claim 20 wherein said free edge extends substantially over the sleeve height between top and bottom walls, and said blank portion and said first inner wall portion are connected by said flap.

22. The sleeve of claim 17 wherein said blank portion has an inner end edge defining with said one large side wall a step.

23. The sleeve of claim 22 wherein said inner end edge extends substantially parallel to said front-defining edge of said one large side wall.

24. The sleeve of claim 23 wherein said inner end edge is spaced a predetermined distance from said free edge of said first inner wall portion.

25. The sleeve of claim 24 wherein said distance varies over the extension of said free edge.

26. The sleeve of claim 1 made of box-board, one face of said box-board being covered by a material having a smooth surface, outer sides of at least said large side walls presenting said smooth surface.

27. The sleeve of claim 26 wherein:

said one large side wall has a second inner wall portion and said second large side wall has a third inner wall portion; and said second and third inner wall portions of said large side walls are integral parts of one single blank folded upon said large side walls and glued thereto.

28. The sleeve of claim 27 having a finger access recess extending from the front-defining edge of at least said one large side wall.

29. The sleeve of claim 28 wherein both said large side walls have said recess, and said recesses being congruent.

30. The sleeve of claim 28 or 29 wherein each recess is located offset with respect to the center of the side wall.

31. The sleeve of claim 28 wherein said recess terminates in front of said free edge.

32. The sleeve of claim 31 wherein said lining portion and said one large side wall portions are glued together adjacent said recess.

33. The sleeve of claim 28 wherein:

a blank portion is provided between said free edge and said front-defining edge of said one large side wall; and said recess terminates in front of an inner edge of said blank portion.

34. The sleeve of claim 1 made from a folded blank which includes:

said large side wall;

top and bottom flaps connected to said one large side wall by parallel first folding lines; and a pocket-defining wall portion connected by second folding lines to first and second flaps, said first and second folding lines being coextensive;

said outer wall portion and said pocket-defining wall portion being connected by a third folding line extending orthogonal to said first and second folding lines;

a first aperture being cut from the inner wall portion, said first aperture being defined by a first edge extending parallel to said third folding line between said second folding lines, and by a second substantially crescent-shaped edge extending between said second folding lines at a location more remote from said third folding line than said first edge; and a second aperture being cut symmetrically with respect to said third folding line, wherein a blank portion area between said crescent-shaped edge and an outer edge forms said first inner wall portion.

35. The sleeve of claim 34 wherein said first and second edges are spaced from one another by a predetermined distance where they join said second folding lines.

36. The sleeve of claim 34 wherein said pocket-defining wall portion is folded about said third folding line onto said one large side wall and is glued thereto in the area between said third folding line and said first edge.

37. The sleeve of claim 36 wherein said first and second flaps are folded away from said outer wall portion by an angle of 90° about said second folding lines.

38. The sleeve of claim 37 wherein said top and bottom wall flaps are folded by an angle of 90° about said first folding lines and glued respectively to said first and second flaps.

39. The sleeve of claim 36 wherein said first and second flaps are folded onto said pocket-defining wall portion prior to said pocket-defining wall portion being folded onto said one large side wall so that said flaps are positioned between said pocket-defining wall portion and said one large side wall.

40. The sleeve of claim 39 wherein said first and second flaps are glued to said large outer wall portion.

41. The sleeve of claim 34 wherein said blank further includes a second large side wall portion connected via a fourth folding line to a rear wall portion, said fourth folding line extending parallel to said third folding line, said rear wall portion in turn being connected via a fifth parallel folding line to said one large side wall at the end of the latter remote from said third folding line.

42. The sleeve of claim 41 wherein said rear wall portion is connected via sixth folding lines coextensive with the first folding lines to end flaps.

43. The sleeve of claim 41 wherein said second large side wall is connected to additional top and bottom wall flaps.

44. The sleeve of claim 41 wherein said second large side wall is connected to a third inner wall portion by a seventh folding line extending parallel to said third folding line at its end opposite to said rear wall portion.

45. The sleeve of claim 44 wherein said third inner wall portion and said second large side wall have equal dimensions.

46. The sleeve of claim 44 including third and fourth flaps connected to said third inner wall portion.

47. The sleeve of claim 44 wherein said third inner wall portion and said second large side wall are glued together.

48. The sleeve of claim 41 including a third aperture intersecting said seventh folding line said third aperture being congruent with the second aperture after erection of the sleeve from said blank.

49. The sleeve of claim 41 wherein each of said large side walls has top end flaps and bottom end flaps, and the top end flaps of both side walls and the bottom end flaps of both side walls are respectively glued together.

50. The sleeve of claim 49 wherein:

said end flaps are folded about said sixth folding lines by about 90° inwards.

51. The sleeve of claim 50 wherein at least one of the two top wall flaps and at least one of the two bottom wall flaps has a recess which is complementary to an opposite end flap.

52. The sleeve of claim 1 wherein at least one of said walls is at least in part transparent.

53. The sleeve of claim 52 wherein said large side wall opposite said pocket is at least in part transparent.

54. The sleeve of claim 52 wherein said rear wall is at least in part transparent.

55. The sleeve of claim 26 wherein said box-board has a predetermined fiber orientation extending substantially parallel to said front-defining side wall edge.

56. The sleeve of claim 1 wherein said sleeve is for a photoprint cassette.

57. The sleeve of claim 1 wherein said pocket is for holding one of (a) negative strips and (b) a bag containing negative strips.

58. The sleeve of claim 1 wherein said first inner wall portion has a first flap adjacent said top wall and a second flap adjacent said bottom wall.

59. The sleeve of claim 1 wherein said flap is glued to said adjacent one wall.

60. The sleeve of claim 1 wherein said first inner wall portion and said one large side wall are folded from a common blank.

61. The sleeve of claim 60 wherein said common blank includes a second inner wall portion joined by a folding line to said one large side wall, and joined by said flap to said first inner wall portion.

62. The sleeve of claim 61 wherein said second inner wall portion and said first inner wall portion are joined additionally by a second flap.

* * * * *